US005998356A

United States Patent [19]

Alam et al.

[11] Patent Number: 5,998,356

[45] Date of Patent: Dec. 7, 1999

[54] PROCESS FOR MAKING GRANULAR DETERGENTS

[75] Inventors: Zayeed Alam; Andrew Dorset, both of Tyne & Wear; Kay Emma Fitzgibbon, Newcastle upon Tyne, all of United Kingdom

[73] Assignee: The Procter & Gamble Company, Cincinnati, Ohio

[21] Appl. No.: 09/043,183

[22] PCT Filed: Sep. 13, 1996

[86] PCT No.: PCT/US96/14864

§ 371 Date: Mar. 12, 1998

§ 102(e) Date: Mar. 12, 1998

[87] PCT Pub. No.: WO97/11149

PCT Pub. Date: Mar. 27, 1997

[30] Foreign Application Priority Data

Sep. 18, 1995 [EP] European Pat. Off. ..... 95306547

[51] Int. Cl.[6] ..... C11D 11/02

[52] U.S. Cl. ..... 510/443; 510/452; 510/507

[58] Field of Search ..... 510/443, 452, 510/507

[56] References Cited

U.S. PATENT DOCUMENTS

| | | | |
|---|---|---|---|
| 4,102,823 | 7/1978 | Matheson et al. | 510/351 |
| 4,415,489 | 11/1983 | Kiczek et al. | 510/532 |
| 4,524,012 | 6/1985 | Wixon | 510/334 |
| 4,604,224 | 8/1986 | Cheng | 510/307 |
| 4,675,127 | 6/1987 | Kickle et al. | 510/452 |
| 4,888,119 | 12/1989 | Klewsaat | 510/329 |
| 4,999,138 | 3/1991 | Nebashi et al. | 510/324 |
| 5,080,820 | 1/1992 | Grecsek | 510/443 |
| 5,118,439 | 6/1992 | Urfer et al. | 510/418 |
| 5,204,010 | 4/1993 | Klewsaat | 510/527 |
| 5,447,651 | 9/1995 | Karpusiewicz et al. | 510/452 |
| 5,565,422 | 10/1996 | Del Greco et al. | 510/443 |

*Primary Examiner*—Lorna M. Douyon
*Attorney, Agent, or Firm*—D. Mitchell Goodrich; Kim William Zerby; Jacobus C. Rasser

[57] ABSTRACT

A process for making granular detergents is disclosed. In a first step, an aqueous slurry is formed. The aqueous slurry comprises anionic surfactant, chelating agents, at least 0.5%, by weight, of sodium aluminosilicate, and inorganic salts of a type which raise the ionic conductivity of the aqueous slurry. The aqueous slurry contains essentially no silicates and has a low viscosity suitable for spray-drying to form crisp, free-flowing powder. After being formed, the slurry is dried to form a particulate detergent composition.

8 Claims, No Drawings

PROCESS FOR MAKING GRANULAR DETERGENTS

The present invention relates to a process for preparing a particulate detergent composition, in particular by spray drying an aqueous slurry. Particulate detergent compositions are also disclosed.

Many granular detergents which are sold commercially comprise sodium aluminosilicate as the sole builder, or as a component of a builder system. It is known, for example from JP204098/1983, laid open on Nov. 28th 1983, that heated aqueous slurries, such as those used in conventional spray-drying processes, which comprise both sodium aluminosilicate and water-soluble silicate, cause insoluble complexes to form. These insoluble complexes are undesirable, in laundry detergents because they can result in residues on washed fabrics. Furthermore, without the silicate to act as a powder structurant, the particle size distribution of the spray-dried powder may be unacceptably broad.

In the absence of water-soluble silicate in the aqueous slurry, various other components have been proposed as powder structurants, useful to achieve a crisp, free-flowing spray-dried powder. Included amongst the powder structurants that have been suggested are film-forming polymer: polycarboxylates (for example, U.S. Pat. No. 4,379,080); polyacrylates (for example, JP204098/1983); sucrose and derivatives (for example, EP-A-0 215 637); sodium sesquicarbonate (for example, EP-A-0 242 138).

However, unless the powder structurants are required by the formulator as active ingredients, then they are an expensive processing aid.

An aqueous slurry which does not comprise either water-soluble silicate, or one of the alternative powder structurants is difficult to spray dry. In particular high water concentrations are generally needed in order to maintain the viscosity of the slurry low enough to provide crisp, free-flowing particles of the desired particle size when spray-dried. The disadvantage of high water concentrations is that the excess water must be removed during the drying step and a lot of energy is needed to do this.

WO90/04630, published on May 3rd, 1990, describes a process for preparing a carbonate containing detergent slurry comprising an alkylpolyglycoside and an alkali metal chloride. Zeolite A is suggested as one possible builder albeit in the presence of silicate (at 7% by weight in Table VI).

The object of the present invention is to avoid residue problems by substantially omitting silicate from an aqueous slurry which comprises anionic surfactant and aluminosilicate, and at the same time to provide a low viscosity slurry suitable for spray-drying to form crisp, free-flowing powder.

SUMMARY OF THE INVENTION

According to the invention this object is achieved by forming an aqueous slurry comprising water, anionic surfactant and at least 0.5% by weight of sodium aluminosilicate and which further comprises less than 5% by weight of silicate and at least 1% by weight of an inorganic salt, or a mixture of inorganic salts, and whereby the addition of the inorganic salt increases the ionic conductivity of the aqueous slurry, and subsequently drying the aqueous slurry to form the particulate detergent composition.

Preferably the inorganic salt is an alkali metal or alkaline earth metal salt, or mixtures thereof of halide, nitrate or citrate, most preferably sodium chloride.

In a more preferred embodiment of the invention the step of adding the inorganic salt raises the ionic conductivity of the aqueous slurry by at least 3 milliSiemens, and preferably by at least 5 milliSiemens.

A further aspect of the invention concerns spray-dried detergent powder compositions. Preferred compositions comprise:

- at least one surfactant, and preferably at least 5% by weight of surfactant most preferably from 5% to 20% of anionic surfactant;
- from 2 to 80%, and preferably from 10% to 50% or from 1% to 50%, preferably 5% to 30% by weight of aluminosilicate;
- from 1% to 50%, preferably 1% to 20%, more preferably from 1% to 10% by weight of an inorganic salt selected from the group consisting of alkali metal halides, nitrates, citrates or mixtures thereof, and preferably from 2% to 10% by weight of an alkali metal, preferably sodium, chloride; and
- less than 5%, preferably less than 2% by weight of silicate.

DETAILED DESCRIPTION OF THE INVENTION

Essential components of the compositions of the present invention are aluminosilicate builders such as those having the empirical formula:

$$M_z\,(zAlO_2)_y]\cdot x\,H_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel et al, issued Oct. 12, 1976. Preferred synthetic crystalline aluminosilicate ion exchange materials useful herein are available under the designations zeolite A, zeolite P(B), zeolite MAP, zeolite X and zeolite Y. In an especially preferred embodiment, the crystalline aluminosilicate ion exchange material has the formula $$Na_{12}\,[(AlO_2)_{12}\,(SiO2)_{12}]\cdot x\,H_2O$$

wherein x is from about 20 to about 30, especially about 27. This material is known as zeolite A. Dehydrated zeolites (x=0–10), and "overdried" zeolites (x=10–20) may also be used herein. The "overdried" zeolites are particularly useful when a low moisture environment is required, for example to improve stability of detergent bleaches such as perborate and percarbonate. Preferably, the aluminosilicate has a particle size of about 0.1–10 micrometers in diameter. Preferred ion exchange materials have a particle size diameter of from about 0.2 micrometers to about 4 micrometers. The term "particle size diameter" herein represents the average particle size diameter by weight of a given ion exchange material as determined by conventional analytical techniques such as, for example, microscopic determination utilizing a scanning electron microscope. The crystalline zeolite A materials herein are usually further characterized by their calcium ion exchange capacity, which is at least about 200 mg equivalent of $CaCO_3$ water hardness/g of aluminosilicate, calculated on an anhydrous basis, and which generally is in the range of from about 300 mg eq./g to about 352 mg eq./g. The zeolite A materials herein are still further characterized by their calcium ion exchange rate which is at least about 2 grains $Ca^{++}$/gallon/minute/gram/gallon (0.13 g $Ca^{++}$/liter/minute/gram/liter) of aluminosilicate (anhydrous basis), and generally lies within the range of from about 2 grains/gallon/minute/gram/gallon(0.13 g $Ca^{++}$/liter/minute/gram/liter) to about 6 grains/gallon/minute/gram/gallon (0.39 g $Ca^{++}$/liter/minute/gram/liter), based on calcium ion hardness. Optimum aluminosilicate for builder purposes exhibit a calcium ion exchange rate of at least about 4 grains/gallon/minute/gram/gallon (0.26 g $Ca^{++}$/liter/minute/gram/liter).

The granular agglomerates of the present invention also comprise other detergent ingredients.

Water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkyl benzene sulfonates in which the alkyl group contains from about 9 to about 15 carbon atoms, in straight or branched chain configuration, e.g., those of the type described in U.S. Pat. Nos. 2,220,099 and 2,477,383; and methyl ester sulphonates. Especially valuable are linear straight chain alkyl benzene sulfonates in which the average number of carbon atoms in the alkyl group is from about 11 to 13, abbreviated as $C_{11}$–$C_{13}$ LAS.

Other anionic surfactants herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and wherein the alkyl groups contain from about 8 to about 12 carbon atoms; and sodium or potassium salts of alkyl ethylene oxide ether sulfates containing from about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; watersoluble salts of olefin sulfonates containing from about 12 to 24 carbon atoms; and beta-alkyloxy alkane sulfonates containing from about 1 to 3 carbon atoms in the alkyl group and from about 8 to about 20 carbon atoms in the alkane moiety.

Water-soluble nonionic surfactants are also useful as surfactants in the compositions of the invention. Indeed, preferred processes use anionic/nonionic blends. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with from 1 to 25 moles of ethylene oxide per mole of alcohol, especially 2 to 7 moles of ethylene oxide per mole of alcohol. Particularly preferred are the condensation products of alcohols having an alkyl group containing from about 9 to 15 carbon atoms; and condensation products of propylene glycol with ethylene oxide.

Other preferred nonionics are polyhydroxy fatty acid amides which may be prepared by reacting a fatty acid ester and an N-alkyl polyhydroxy amine. The preferred amine for use in the present invention is N-(R1)-CH2(CH2OH)4-CH2-OH and the preferred ester is a C12–C20 fatty acid methyl ester. Most preferred is the reaction product of N-methyl glucamine (which may be derived from-glucose) with C12–C20 fatty acid methyl ester.

Methods of manufacturing polyhydroxy fatty acid amides have been described in WO 9206073, published on Apr. 16th, 1992. This application describes the preparation of polyhydroxy fatty acid amides in the presence of solvents. In a highly preferred embodiment of the invention N-methyl glucamine is reacted with a C12–C20 methyl ester. It also says that the formulator of granular detergent compositions may find it convenient to run the amidation reaction in the presence of solvents which comprise alkoxylated, especially ethoxylated (EO 3–8) C12–C14 alcohols (page 15, lines 22–27). This directly yields nonionic surfactant systems which are suitable for use in the present invention, such as those comprising N-methyl glucamide and C12–C14 alcohols with an average of 3 ethoxylate groups per molecule.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium phosphonium, and sulfonium compounds in which one of the aliphatic substituents contains from about 8 to 18 carbon atoms.

Useful cationic surfactants include water-soluble quaternary ammonium compounds of the form $R_4R_5R_6R_7N^+X^-$, wherein $R_4$ is alkyl having from 10 to 20, preferably from 12–18 carbon atoms, and $R_5$, $R_6$ and $R_7$ are each $C_1$ to $C_7$ alkyl preferably methyl; $X^-$ is an anion, e.g. chloride. Examples of such trimethyl ammonium compounds include $C_{12-14}$ alkyl trimethyl ammonium chloride and cocalkyl trimethyl ammonium methosulfate.

The granular detergents of the present invention can contain neutral or alkaline salts which have a pH in solution of seven or greater, and can be either organic or inorganic in nature. The builder salt assists in providing the desired density and bulk to the detergent granules herein. While some of the salts are inert, many of them also function as detergency builder materials in the laundering solution.

Useful water-soluble salts include the compounds commonly known as detergent builder materials. Builders are generally selected from the various water-soluble, alkali metal, ammonium or substituted ammonium phosphates, polyphosphates, phosphonates, polyphosphonates, carbonates, silicates, borates, and polyhyroxysulfonates. Preferred are the alkali metal, especially sodium, salts of the above.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4.

Polymers

Also useful are various organic polymers, some of which also may function as builders to improve detergency. Included among such polymers may be mentioned sodium carboxy-lower alkyl celluloses, sodium lower alkyl celluloses and sodium hydroxy-lower alkyl celluloses, such as sodium carboxymethyl cellulose, sodium methyl cellulose and sodium hydroxypropyl cellulose, homo & co polymers of amino acids (particularly homo and co polymers of aspartic acid glutamic acid), polyvinyl alcohols (which often also include some polyvinyl acetate), polyacrylamides, polyacrylates and various copolymers, such as those of maleic and acrylic acids, in particular maleic/acrylic/vinyl alcohol terpolymers. Molecular weights for such polymers vary widely but most are within the range of 2,000 to 100,000. Other suitable polymers are polyamine N-oxide polymers, copolymers of N-vinylpyrrolidone and N-vinylimidazole, polyvinylpyrrolidone polymers, polyvinyloxazolidones and polyvinylimidazoles or mixtures thereof.

Polymeric polycarboxyate builders are set forth in U.S. Pat. No. 3,308,067, Diehl, issued Mar. 7, 1967. Such materials include the water-soluble salts of homo-and copolymers of aliphatic carboxylic acids such as maleic acid, itaconic acid, mesaconic acid, fumaric acid, aconitic acid, citraconic acid, methylenemalonic acid, methyl acrylic and PEG. In the present invention it is preferred that polymeric polycarboxylates are substantially omitted from the aqueous slurry. By substantially omitted, less than 5% by weight of the aqueous slurry is preferred, and less than 2% by weight is more preferred.

Inorganic Salts

Whilst the skilled person has a wide range of inorganic salts from which to choose, it is an essential feature of the present invention that the inorganic salt should result in an increased ionic conductivity of the aqueous slurry. The ionic conductivity of the aqueous slurry depends not only on the inorganic salt used, but also on the amount of inorganic salt used, and also on the composition of the aqueous slurry. Halides, especially chlorides, nitrates and citrates have been found to be particularly effective inorganic salts which when used at the preferred levels, have the effect of increasing the ionic conductivity of the aqueous slurry. Carbonates and sulphates are less effective, and may well cause a decrease in the ionic conductivity of the slurry. Without wishing to be bound by theory, it is believed that the higher ionic conductivity of the aqueous slurry suppresses the formation of highly viscous surfactant phases which are subsequently difficult to dry. By promoting less viscous surfactant phases the aqueous slurry is more readily formed into free-flowing, crisp particles having a good particle size distribution.

Silicone Oils

Particulate suds suppressors may also be incorporated into the finished composition by dry adding. Preferably the suds suppressing activity of these particles is based on fatty acids or silicones.

Optionals

Other ingredients commonly used in detergent compositions can be included in the compositions of the present invention. These include flow aids, color speckles, bleaching agents and bleach activators, suds boosters or suds suppressors, antitarnish and anticorrosion agents, soil suspending agents, anionic and nonionic soil release agents, dyes, clays, flocculating agents, STS, fillers, optical brighteners, germicides, pH adjusting agents, nonbuilder alkalinity sources, hydrotropes, enzymes, enzyme-stabilizing agents, chelating agents, (including EDDS) and perfumes.

These optional ingredients, especially optical brighteners, may be incorporated either directly in the agglomerates herein or may be components of separate particles suitable for dry adding to the agglomerates of the present invention.

Processing

The aqueous slurry may be prepared by a batch or continuous process. Most conveniently a batch mixer, or "crutcher" is used in which the various detergent components or dissolved in, or slurried with, water. Typically the aqueous slurry contains from about 20% to about 60% by weight of water, in particular from about 30% to about 40% by weight of water. This is referred to as the crutcher mix moisture. In the process of the present invention, the order of addition of the inorganic salt and the other components of the aqueous slurry (or "crutcher mix") is not considered to be critical. It is an essential feature of the present invention that the ionic conductivity of the aqueous slurry which comprises the inorganic salt must be greater than the ionic conductivity of the aqueous slurry in the absence of the inorganic salt. It is preferred that the addition of the inorganic salt results in an aqueous slurry having an ionic conductivity which is at least 3 milliSiemens higher than a corresponding aqueous slurry from which the inorganic salt has been omitted.

The drying of the aqueous slurry may be achieved by any one of several processes known to the skilled man, but it is preferably prepared by spray drying. Following the spray drying route, an aqueous slurry is prepared comprising the solids. The slurry is then pumped at high pressure through atomising nozzles into a drying tower where excess water is driven off, producing a flowable powder. The resulting powder may then be oversprayed with liquid ingredients, especially nonionic surfactants for which the powder has a high adsorption capacity before it loses its good flow characteristics. Other powdered components of the finished laundry detergent may be dry mixed with the flowable powder produced by the above process.

TEST METHOD

Procedure for the Conductivity Test

1. Prepare a 15 kg sample of aqueous slurry ready for spray drying.

2. Place the sample in a large bucket 400 mm diameter and 500 mm in height.

3. Let the mix cool to 30° C.

4. Using a Jenwat 4020 Conductivity Meter, measure the conductivity of the aqueous slurry.

EXAMPLES

| | Aqueous Slurry Composition (% by weight) | | | | |
|---|---|---|---|---|---|
| | Reference | Ex. 1 | Ex. 2 | Ex. 3 | Ex. 4 |
| LAS | 11.2 | 11.2 | 11.7 | 11.2 | 11.2 |
| Zeolite A | 26.2 | 26.2 | 30.0 | 26.2 | 26.2 |
| Water | 33.0 | 33.0 | 34.5 | 33.0 | 33.0 |
| Chelant | 0.3 | 0.3 | 0.3 | 0.3 | 0.3 |
| Brightener | 0.1 | 0.1 | 0.1 | 0.1 | 0.1 |
| Magnesium Sulphate | 0.3 | 0.3 | 0.3 | 0.3 | 0.3 |
| Carboxy Methyl Cellulose | 0.3 | 0.3 | 0.3 | 0.3 | 0.3 |
| HEDP | 0.3 | 0.3 | 0.3 | 0.3 | 0.3 |
| Copolymer of acrylic & maleic acid | 0.4 | 0.4 | 0.4 | 0.4 | 0.4 |
| Miscellaneous | 2.2 | 2.2 | 2.3 | 2.2 | 2.2 |
| Sodium Sulphate | 25.7 | 21.4 | 21.4 | 24.3 | 18.5 |
| Sodium Chloride | 0 | 4.3 | 1.4 | 7.2 | 0 |
| Sodium Citrate | 0 | 0 | 0 | 0 | 4.3 |
| Conductivity (milliSiemens) | 10 | 19 | 17 | 21 | 13 |

| | Aqueous Slurry Composition (% by weight) | | | | |
|---|---|---|---|---|---|
| | Ex. 5 | Ex. 6 | Ex. 7 | Ex. 8 | Ex. 9 |
| LAS | 11.2 | 11.2 | 11.7 | 11.2 | 11.2 |
| Zeolite A | 26.2 | 26.2 | 30.0 | 26.2 | 26.2 |
| Water | 33.0 | 33.0 | 34.5 | 33.0 | 33.0 |
| Chelant | 0.3 | 0.3 | 0.3 | 0.3 | 0.3 |
| Brightener | 0.1 | 0.1 | 0.1 | 0.1 | 0.1 |
| Magnesium Sulphate | 0.3 | 0.3 | 0.3 | 0.3 | 0.3 |
| Carboxy Methyl Cellulose | 0.3 | 0.3 | 0.3 | 0.3 | 0.3 |
| HEDP | 0.3 | 0.3 | 0.3 | 0.3 | 0.3 |
| Copolymer of acrylic & maleic acid | 0.4 | 0.4 | 0.4 | 0.4 | 0.4 |
| Miscellaneous | 2.2 | 2.2 | 2.3 | 2.2 | 2.2 |
| Sodium Sulphate | 21.4 | 21.4 | 21.4 | 21.4 | 21.4 |
| Potassium Chloride | 4.3 | 0 | 0 | 0 | 0 |
| Potassium Nitrate | 0 | 4.3 | 0 | 0 | 0 |
| Potassium Citrate | 0 | 0 | 4.3 | 0 | 0 |
| Calcium Chloride | 0 | 0 | 0 | 4.3 | 0 |
| Caicium Nitrate | 0 | 0 | 0 | 0 | 4.3 |
| Conductivity (milliSiemens) | 19 | 17 | 13 | 16 | 14 |

The aqueous slurry is heated to 70° C. and is fed through to a series of pressure pumps. This increases the pressure of the mix up to 80 bar. Air is then injected into the mix at a pressure of 100 bar. The high pressure mix is then directed to the top of the spray drying tower. Here it is blown through a set of nozzles, which range in aperture diameter up to 1 mm. These atomise the slurry into droplets. The moisture is driven off these particles as they fall through the tower with a residence time of up to 180 seconds by contact with hot air at 275° C. At the bottom of the tower a blown powder is collected with a density in the range of 300–550 g/l. The resulting blown powder has a moisture in the range of 5–15% with the majority of the particles having a size in the range of 150–1200 micrometers.

We claim:

1. A process for preparing a particulate detergent composition which comprises:

(a) forming an aqueous slurry comprising water, an anionic surfactant as the sole surfactant, chelating agents and at least 0.5%, by weight, of sodium aluminosilicate and copolymers of acrylic and maleic acid as the sole builders;

(b) adding to the aqueous slurry an inorganic salt selected from the group consisting of:
(i) alkali metal salts of halides and nitrates;
(ii) alkaline earth metal salts of halides and nitrates; and
(iii) mixtures thereof;

(c) drying the slurry;

wherein the aqueous slurry comprises at least 1% by weight of the inorganic salt, and whereby the addition of the inorganic salt increases the ionic conductivity of the aqueous slurry, and wherein the aqueous slurry contains essentially no water-soluble silicate and the particulate composition comprises from 5% to 20% by weight, of the anionic surfactant.

2. A process according to claim 1 wherein the step of adding the inorganic salt raises the ionic conductivity of the aqueous slurry by at least 3 milliSiemens.

3. A process according to claim 1 wherein the step of adding the inorganic salt raises the ionic conductivity of the aqueous slurry by a least 5 milliSiemens.

4. A process according to claim 1 wherein the inorganic salt is sodium chloride.

5. A process according to claim 1 wherein the range of inorganic salt is 1% to 50% by weight.

6. A process according to claim 1 wherein the aqueous slurry comprises from 4.3% to 7.2% of inorganic salt.

7. A process according to claim 1 wherein the range of sodium aluminosilicate is 1% to 50% by weight.

8. A process according to claim 7 wherein the range of sodium aluminosilicate is 5% to 30% by weight.

* * * * *